United States Patent [19]

Spreafico

[11] 4,286,449

[45] Sep. 1, 1981

[54] MACHINE FOR MECHANICAL PICKLING OF WIRES WITH THE AID OF ROLLING

[76] Inventor: Bruno Spreafico, Via Valle Scura 2, Malgrate (Como), Italy

[21] Appl. No.: 25,596

[22] Filed: Mar. 30, 1979

Related U.S. Application Data

[63] Continuation-in-part of Ser. No. 832,064, Sep. 9, 1977, abandoned.

[30] Foreign Application Priority Data

Sep. 21, 1976 [IT] Italy ..... 27415/76
Nov. 15, 1976 [IT] Italy ..... 29328/76

[51] Int. Cl.[3] ..... B21B 45/04; B21B 45/02

[52] U.S. Cl. ..... 72/40; 29/81 F; 29/81 H; 15/21 D

[58] Field of Search ..... 72/39, 40; 29/81 A, 29/81 F, 81 H, 81 J; 15/21 D, 197, 198, 179; 51/90

[56] References Cited

U.S. PATENT DOCUMENTS

| | | | |
|---|---|---|---|
| 293,011 | 2/1884 | Hall et al. | 29/81 A |
| 919,785 | 4/1909 | Silver | 29/81 F |
| 931,897 | 8/1909 | Thibodeau | 29/81 F |
| 997,167 | 7/1911 | Werth | 29/81 F |
| 1,230,584 | 6/1917 | Lally | 29/81 F |
| 1,317,714 | 10/1919 | Locke | 29/81 A |
| 1,647,499 | 11/1927 | Bly | 29/81 H |
| 1,862,107 | 6/1932 | Brueckner et al. | 72/40 |
| 2,242,024 | 5/1941 | Dillon | 29/81 A |
| 2,680,938 | 6/1954 | Peterson | 29/81 F |
| 3,780,552 | 12/1973 | Staskiewicz et al. | 72/40 |

*Primary Examiner*—Daniel C. Crane
*Attorney, Agent, or Firm*—Haseltine and Lake

[57] ABSTRACT

An apparatus for cleaning small diameter metal wires employing two sets of brushes arranged in pairs on the sides of the wire advancing into the apparatus. The respective sets of brushes each are at perpendicular planes to one another and define an enclosed sector of 180° of the wire to be treated. The tips of the brushes co-act with the advancing wire to cause cleaning. A counterweight pressure assembly urges the brushes against the wire without promoting spreading of the wire elements of the brushes as the brushes wear out.

4 Claims, 9 Drawing Figures

MACHINE FOR MECHANICAL PICKLING OF WIRES WITH THE AID OF ROLLING

BACKGROUND OF INVENTION

The present invention is a Continuation-In-Part of my co-pending application, entitled A Machine and Method for Mechanical Pickling of Wires with the Aid of Rolling, U.S. Ser. No. 832,064, filed Sept. 9, 1977.

This invention relates to a machine for cleaning small diameter wires, such as those from steelworks and intended for drawing, or previously drawn and annealed, and/or for subsequent treatment where full cleaning of the surface thereof is required. Usually the metal wires are covered with scales or slag, various oxides, calamine, etc., which should be removed to leave the wire fully cleaned before the successive drawing operations reduce the diameter to a desired size, or subsequent to the drawing operation.

The prior art provides two different series of cleaning or pickling operations, depending on the desired degree of cleaning or pickling. In the first instance, cleaning of the product from the steelworks is often mechanically performed by various systems of mechanical removal, depending on the type of material and shape thereof (such as wire, bar, ingot, sheet or plate, etc.). To this end, and particularly as far as wires are concerned, scaling machines are known, such as that disclosed in U.S. Pat. No. 2,242,024 (Dillon). According to this arrangement, toothed sheaves and gear wheels are provided by which metal wire passing therethrough is flexed and distorted so as to break up and separate the scales or slag and other surface impurities. Then a ball mill or brushes or other scraping devices are employed for fully separating the scales or slag and for more thorough cleaning of the wire.

Other systems previously known or experimented with comprise, grinding wheels of different types, jets of abrasive material, systems provided with a rotating cylinder containing pneumatic pressure abrasive materials, wide or cup brushes with the sides thereof perpendicular to the wire to be processed, and so on.

All of the above are specific mechanical type systems and processes which are advantageous for a first or rough cleaning of the wire, where the product thus obtained is used and where a full or thorough surface cleaning is not required. In these latter cases, the prior art provides the use of chemical pickling by means of baths in acidic or basic solutions performing a complete removal by chemical means of the oxide layer, among which is calamine, which may have remained adhered to the wire, notwithstanding the previous mechanical cleaning operation. The prior art often provides the use of chemical pickling following the mechanical cleaning and descaling, either because the latter is unable to provide a wire having its surface fully cleaned, or also because it would be wasteful to directly use a chemical pickling bath to remove the coarsest slag and surface impurities of the wire that could be also mechanically removed.

There are other prior art methods and systems for the cleaning of bars, ingots, tubes and the like, but which are completely unsuitable for application of thin wires (that is, of a diameter to about 10 mm), for example, such as those disclosed in U.S. Pat. Nos. 1,647,499 (Bly); 1,230,584 (Lally); and 3,780,552 (Staskiewicz).

The basic disadvantages of the prior art are mainly due to the impossibility of providing a thorough cleaning of the surface of thin wires by machines using sheaves and gear wheels or ball mills, as described in U.S. Pat. No. 2,242,024 (Dillon) or by using brushes or other scraper means. Particularly, the brushes are satisfactory for discrete cleaning on bars, tubes or products exhibiting a discrete surface on which a brush is capable of operating. However, in case of thin wires which are not quite straight or rectilinear and that may partly rotate about their own axis during the cleaning operations (as a result of the applied dragging force), or which may be also deformed at a given section thereof by the several operations to which it has been subjected; such known systems, and particularly the brushes hitherto used also in combination with other devices, are quite unsatisfactory.

SUMMARY OF INVENTION

It is the main object of the present invention to overcome the defects of the prior art.

It is another object of the present invention to provide a machine capable of performing a full or thorough cleaning of the surface of thin metal wires, equivalent to a chemical pickling, by merely mechanical means.

It is still another object of the present invention to provide a machine to perform such a cleaning operation of the wire surface by the combined action of flanged brushes arranged laterally of and offset to the wire, which are pressed thereagainst with a constant and adjustable pressure value or rate, so that the brush wires always have a tip or point, bearing against the wire to be cleaned and the brush consumption or wear occurs by the building up of a channel within the brush and lamination means.

It is another object of the present invention to provide a machine, where the laminating means thereby provided allow a full removal of the scales or slag and at the same time a restoration of the original circular section to the wire which is deformed due to hot rolling at the steelworks.

It is still a further object of the present invention to provide a machine for surface cleaning of metal wires, which is of a low cost as to the complete exploitation of the brushes which are gradually and smoothly consumed or worn out owing to the gradual penetration of the wire in the brush during the consumption.

It is still a further object of the present invention to provide a machine, wherein each of the brushes perform the cleaning of a wire surface corresponding to about 180° of the same, thus ensuring a thorough cleaning of the wire by using a limited number of brushes, which are arranged offset and angularly along said wire in the machine.

These and other related objects will become apparent from the following specification, claims and drawings relating to the present invention.

BRIEF DESCRIPTION OF THE DRAWINGS

The invention will now be described in a preferred embodiment with reference to the accompanying drawings, in which.

DETAILED DESCRIPTION OF AN EMBODIMENT

Figure 1:
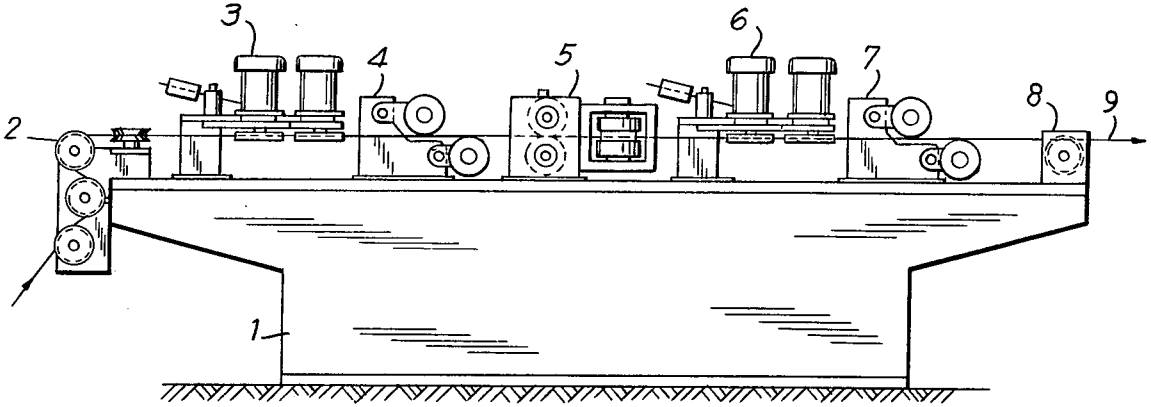
FIG. 1 is a side view showing the machine for the cleaning of metal wires according to the invention.
Figure 2:
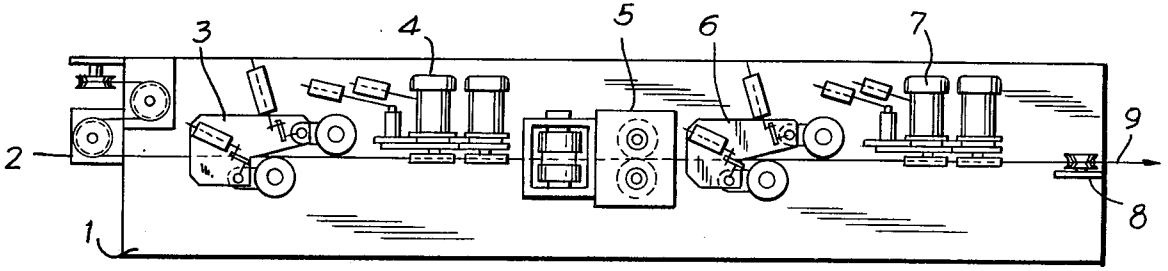
FIG. 2 is a top view of the machine shown in FIG. 1.

The machine for metal wire cleaning shown in FIGS. 1 and 2 comprises a prismatic base 1 with a bearing plane of a larger length than its width, having mounted thereon a set of splined pulleys 2, arranged on different planes and somewhat offset to one another; two sets of brushes 3 and 4, respectively, located on substantially perpendicular planes, a rolling unit 5 comprising two rolling assemblies or units on substantially orthogonal planes and two additional sets of brushes 6 and 7 substantially arranged as said sets of brushes 3 and 4. An additional splined pulley or sheave 8 is provided at the end of the machine.

The machine is provided for interposition between the wires exiting from the steelworks which are wound up in rolls (not shown) and a drawing machine for diameter reduction, which also supplies the required traction for a wire 9 passing through the machine for surface cleaning. As required, the machine could be used also for only cleaning previously drawn and annealed wires. It should be noted that a wire entering the machine has rather reduced sizes to a maximum of 12 mm in diameter, and has in addition to surface slag and oxides, also waxes and deviations from its axis, making it difficult to define an axis of symmetry, about which the cleaning elements can be arranged. However, it is essential that the machine allow a thorough cleaning at a high passage speed of the wire, for example in the range of 3–4 m/sec, so that the machine can be directly coupled to a drawing machine for continuous cycle processing. The splined sheaves 2 perform different functions. That is, the sheaves serve the purpose of starting a first removal of the slag and aid in separating and breaking up the latter by sliding of wire 9 within the sheave splines. They also cooperate in removing part of the waving on the wire and stretch the latter for subsequent processing, exerting a pressure action against dragging. They are arranged in sets on planes at right angles to one another, and are similar to those provided in said U.S. Pat. No. 2,242,024. However, these sheaves conveniently allow removal of the coarsest portion of the slag without unnecessarily wearing out the wires of brushes 3 and 4. Apart from the counterweight system, the sets of brushes 3 and 4 are similar.

The operation will now be described particularly for set 3, while for set 4 only the difference between the pressure adjusting members will be shown.

The brush set 3 comprises two brushes 18 mounted on the axes or shafts of two motors 10, rockingly supported by flanges 11 pivoted by a pin 12 on a supporting plate 13 connected to a standard 16 integral with the machine plane 1.

The brushes 18 are rotated by motors 10 in a direction which is preferably opposite to the feeding of wire 9 shown by the arrow (see FIG. 4) at not too high a speed, since the brushing effect occurs at a relative speed given by the sum of the tangential speed of the brush wires and linear of wire 9. A speed of 2800 r.p.m. for the rotation of the motor with brushes having a diameter of 18 cm is typically considered as an optimum speed to avoid any overheating of the wire to be cleaned.

The brushes are kept pressed against the wire by counterweight devices to be more particularly described hereinafter and are preferably arranged at the position shown in FIG. 4 only at the start of processing when such brushes are still new.

Figure 8:
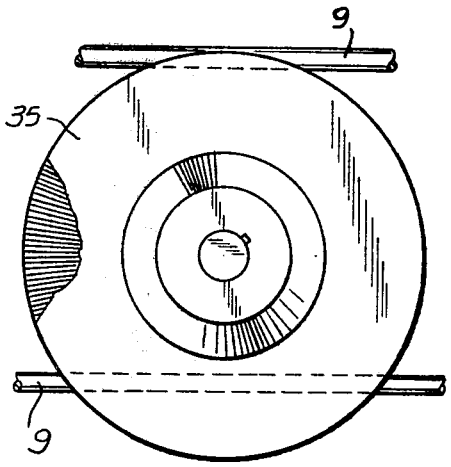
FIGS. 8 and 9 are views showing an embodiment for the brushes according to the invention.
Figure 9:
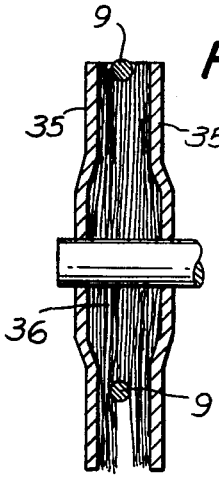

As better shown in FIGS. 8 and 9, the brushes are provided with flanges 35 substantially extending throughout the brush diameter, so as to maintain the brush wires always correctly aligned and laterally compressed for tip or point processing of said wire 9. Moreover, said flanges are convergent or in any case tend to get narrower toward the periphery to compensate for the reduced density of the brush wires to the periphery of the brush, maintaining the same always homogeneous and at a constant density. Owing to such a structure of the brushes and the selected arrangement, a wire 9 to be cleaned gradually penetrates inside the brush wires, as better shown at the bottom of FIG. 9, as the wires of the brush wear out. Thus, a circumferential channel is formed in the brush, so that the wires of the latter will enclose a sector or arc of 180° of the wire to be processed, on which the brush carries out a point or tip working, as the wires of the brush are maintained correctly aligned and radially pressed. The substantial absence of spreading in the brush wires enables the use of extremely hardened wires for such brushes which otherwise could not be used due to their brittleness. Therefore, wire cleaning according to the above is by far superior to that obtainable by the brushes hitherto used in the prior art, which brushes could not be of hardened wires or in any case of a high hardness, and which additionally did not provide a smooth thorough cleaning of a wire due to the irregular spreading thereof.

Figure 3:
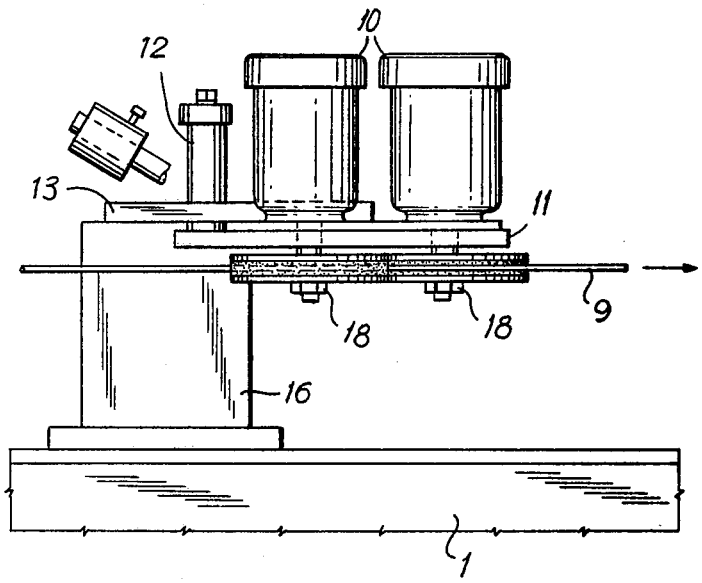
FIGS. 3 and 4 are side and plan views, respectively, showing a set of brushes for a machine according to the invention.
Figure 4:
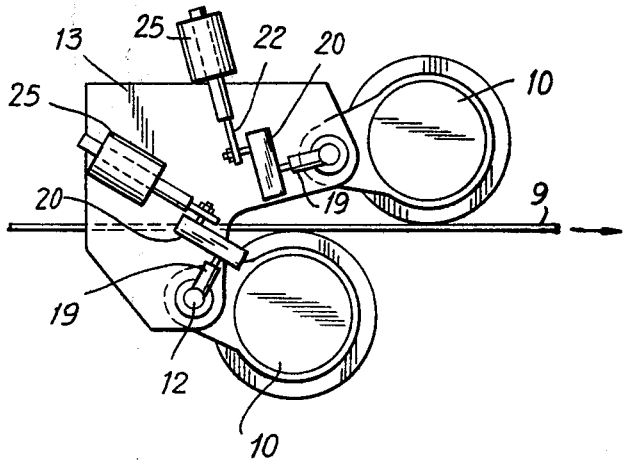
Figure 5:
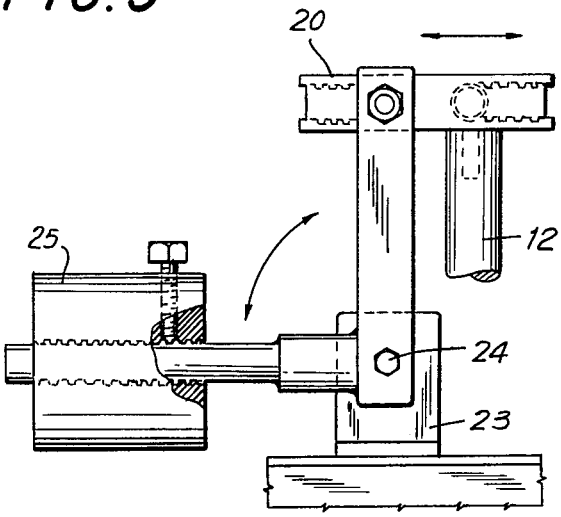
FIG. 5 is a view showing a device for adjusting the pressure on the brushes.

The arrangement shown in FIGS. 3 and 4 enables cleaning throughout the wire surface due to the pair of brushes 18 arranged on the opposite sides of the wire on a same horizontal plane.

However, since the cleaning action is most effective at the side portions of the wire, the set of horizontal brushes is followed by a second set of vertical brushes 4, having parallel functions and similar as to structure apart from the different structure of the counterweights. Thus, by four brushes, at least a double working run is obtainable for each point or location on the wire surface. Furthermore, any irregularities of the wire and rotation of the latter about its own longitudinal axis do not give rise to wire surface sections or lengths unprocessed by any brush.

A device for adjusting the brush pressure is also shown in FIGS. 3 and 4 for the brush set 3. Such a device comprises a counterweight 25 adjustably mounted on an arm of an L-lever pivoting to a support or bearing 23 integral with the plane or table 1, and this through a pin 24. The upper end of the other arm 22 of the L-lever is connected by a ball-and-socket joint with pin 12, so that a component of the force of gravity acting on counterweight 25 is horizontally transmitted to flange 13, pressing the brush against the wire. Such pressure can be adjusted by suitably changing the position for the counterweight 25 along the lower run or length of the rod, also in connection with the diameter of the wire to be processed.

Figure 6:
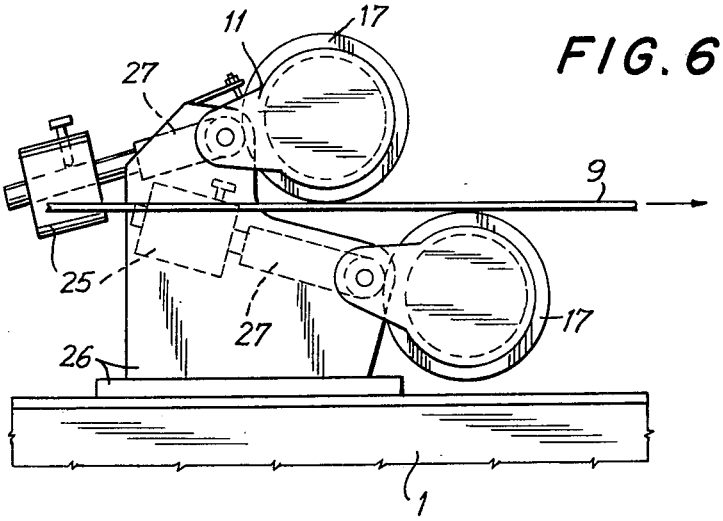
FIG. 6 is a side view of a set of brushes according to the invention.

The structure of the pressure device for the vertical brushes, as shown in FIG. 6, is much more simple, being formed by counterweight 25 directly acting on a rod 27 pivoted to the flange. It was found that the counterweight adjusting system for the brush pressure, as above described, is the most suitable for use in a dusty environment, such as that for its intended operation and mainly because of its reduced weight. Thus, it is submitted that no other device can provide a particularly light-weight system, capable of following the wire waving, minimum separation as possible of the brushes at an irregularity of the wire. It should also be noted, that the wire speed relative to the brush wire tips or points is quite high and a more "rigid" pressure system could easily bring about the breakage of the wire to be cleaned. In case of minimal diameters of 2–3 mm, such wires could therefore be also processed by the machine according to the invention to remove the residual annealing slag.

Additionally, the counterweight system affords a finer graduation of the applied weight during the operation and independently for each of the brushes, by moving the counterweight along the L-lever or rod. The two sets of brushes are substantially arranged on perpendicular planes and particularly, also to simplify the type of counterweight being used, the set of brushes 4 is arranged on a vertical plane, and accordingly the set of brushes 3 is arranged on a horizontal plane. Small variations about this position are permissible but it was found that this is substantially the most convenient arrangement for an improved and thorough cleaning of the wire.

Figure 7:
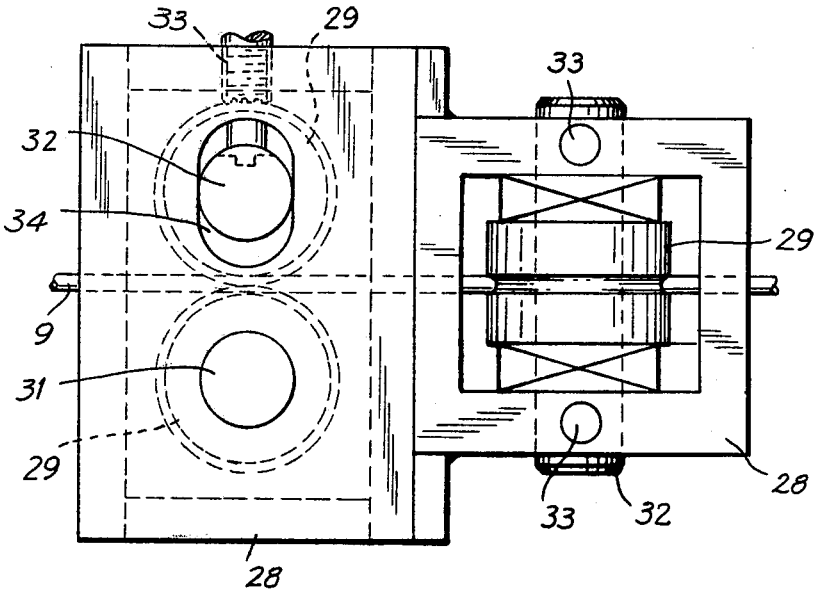
FIG. 7 is a top view of the rolling or laminating units according to the invention.

A rolling assembly 5 is arranged downstream of the first set of bruhses and comprises a rolling or laminating unit having a horizontal axis followed by a successive rolling unit having a vertical axis. Since the units are similar, only the unit having a horizontal axis will be described. Such a unit comprises (see FIG. 7) two rolling cylinders 29 which are idle about their own axes 31 and 32, respectively. As better shown at the right of FIG. 7, these cylinders 29 have semicircular peripheral grooves or splines which are so arranged as to define a circular passage for the wire. An axis 31 is fixed relative to the cylinder base, while axis 32 is adjustable in position in a seat 34 by side screws 33 (of which only one is shown in the drawing) in engagement with a helical screw and a gear (not shown), to manually compensate for gradual wearing as the work is being carried out. The purposes and operations of the rolling or laminating assembly are numerous. First, they enable effective and fast crushing of the slag without any need of adding a large number of brushes. Thus, the coupling of the machine to a high speed drawbench would not allow enough time of contact with the brushes for a thorough cleaning of the wire, which is instead achieved by the rolling or laminating units.

Secondly, the rolling or lamination thus produced enables restoration of the desired degree of roundness to the wire which is usually altered by the hot rolling in the steelworks. Additionally, the rolling or laminating assembly partially removes the roughness of the wire hotrolling and affords a slight elongation of the wire, which is advantageous for the complete removal of the scales due to stretching which is not the same as that of the scales or slag. Moreover, since rolling is not perfect at the contact locations of the two cylinders and, as mentioned above, the wire has some rotation about its own axis, the two rolling or laminating units are arranged at 90° to each other, and one just after the other, so that at the outlet thereof a wire has a round section without any irregularities.

The idle cylinders are rotatably driven by the wire 9 and in order to prevent expansion in an axial direction due to overheating, fans are provided with air conveyors (not shown) for cylinder cooling. For simplicity sake, further devices for the total operation have not been described; however, the operativeness is quite clear from the above description and drawings.

Two other sets of brushes 6 and 7, respectively, are arranged following or downstream of the rolling mill, which are substantially similar to the above described sets of brushes 3 and 4. The main differences are of a technical character, due to the reduced pressure exerted on the wire, sizes of the brush wires, and speed of rotation of the brushes. Therefore, at the outlet of these last mentioned sets of brushes, the wire 9 is thoroughly cleaned, ready for drawing to which it is immediately fed, with perfectly circular section, and also with a reasonable degree of roughness, as imparted by the last brushes to compensate for the rolling mill effect. The minimum degree of roughness is essential to retain the required amounts of lubricant (of different stearates) as necessary for a correct drawing operation. At the end of drawing, the lubricant is then eliminated by washing thus leaving the wire of the desired dimensions thoroughly polished and cleaned.

BEST MODE OF INVENTION

The apparatus for cleaning small diameter metal wires employs two respective pairs of brushes 3,4 and 6,7 at one end of the apparatus for interposition between an advancing wire 9 to be treated. The respective brushes are disposed at substantially perpendicular planes with respect to one another. At an opposite end of the apparatus is a sheave 8 which serves to initially break up the slag on the wire 9 as it passes therethrough. The brushes are rotated in a direction opposite to wire feed direction, as they are urged against wire 9 by a counterweight assembly for the tips of the brushes to penetrate the wire surface. The respective brushes 3,4 and 6,7 each enclose a sector of the wire 9 at which working takes place. Pressure of the brushes against the wire 9 is carried out through a counterweight 25 adjustably mounted with respect to a table 1 of the apparatus.

Many modifications and variations of the present invention are possible in light of the above teachings. It is, therefore, to be understood that within the scope of the appended claims, the invention may be practiced otherwise than as particularly described.

What I claim is:

1. An apparatus for rolling and cleaning small diameter metal wires being advanced into said apparatus, said cleaning apparatus being driven by independent means, comprising in combination: a supporting plane on which said apparatus is positioned a first set of rotary brushes arranged in pairs on said apparatus and being disposed at the sides of the advancing wire, said brushes in each pair having axes with the axes of adjacent pair of brushes being substantially perpendicular with respect to one another, each of said rotary brushes being flanged throughout their diameter so as to laterally compress and maintain alignment of the bristles of each of said brushes and being rotated by an independent motor in a direction opposite to wire feed direction, said brushes further defining an enclosed section or arc of about 180° of the wire, said brushes having bristles with tips co-acting in respect of the advancing wire by a flange holding action formed at the interface thereof, wire rolling means downstream of said first set of brushes; a second set of said flanged rotary brushes arranged in pairs on the sides of the wire with each pair of brushes having axes and the axes of adjacent pairs of brushes being substantially perpendicular with respect to one another, each of said brushes being rotated by an independent motor in a direction opposite to the wire advance direction to define an enclosed sector or arc of about 180° of the wire, wherein the bristles of said set of brushes coact with surfaces of the advancing wire in response to a restraining action by said flange restraining means formed at the interface thereof to permit a minimum and constant tip bending at a tangent with respect to the bristles; and counterweight pressure means for pressing said brushes against the wire penetrating into the brushes, without substantial spreading of the bristles of the latter as said brush bristles are being worn out.

2. An apparatus for metal wire rolling and cleaning according to claim 1, wherein: at least one pair of brushes is arranged on a substantially horizontal plane, each of said brushes being mounted on the axis of an electric asynchronous motor and being carried by a flange pivoted to said supporting plane; said brushes being kept pressed against the wire by said pressure means, defined by a counterweight mounted on a portion of a rod rotatably connected to said supporting plane and by a ball-and-socket joint to a motor supporting flange.

3. An apparatus for metal wire rolling and cleaning according to claim 1 wherein: said rolling means comprises at least two rolling units with their axes arranged substantially perpendicular to one another, each of which comprise, first and second facing idle cylinders having semicircular grooves for the passage of said wire, of which said first cylinder is rotatable about a stationary axis, and said second cylinder is rotatable about an axis parallel to said first; and wear compensation means for maintaining a constant wire diameter employing means for adjusting the relationship of said cylinders for groove wear, by urging gradual movement of said cylinders in a predefined manner; said compensation means having means to adjust the relative position of said cylinders along respective guides in response to wear.

4. An apparatus as claimed in claim 1, wherein; interspaces formed between said flanges are shaped to become narrower in a direction toward the periphery of each of said brushes.

* * * * *